United States Patent [19]

Kosaka et al.

[11] Patent Number: 4,889,841

[45] Date of Patent: Dec. 26, 1989

[54] THERMOSENSITIVE RECORDING MATERIALS

[75] Inventors: Takao Kosaka, Himeji; Masahiro Miyauchi, Takasago; Naomasa Koike; Masahiro Higuchi, both of Tokyo, all of Japan

[73] Assignee: Mitsubishi Paper Mills Limited, Tokyo, Japan

[21] Appl. No.: 220,454

[22] Filed: Jul. 18, 1988

[30] Foreign Application Priority Data

Jul. 25, 1987 [JP] Japan ..... 62-185753
Sep. 11, 1987 [JP] Japan ..... 62-227715

[51] Int. Cl.[4] ..... B41M 5/18

[52] U.S. Cl. ..... 503/209; 428/913; 503/208; 503/225

[58] Field of Search ..... 427/150–152; 503/208, 209, 225; 428/913

[56] References Cited

U.S. PATENT DOCUMENTS 4,742,042 5/1988 Hiraishi et al. ..... 503/201

FOREIGN PATENT DOCUMENTS 3601645 1/1986 Fed. Rep. of Germany ..... 503/209

*Primary Examiner*—Bruce H. Hess

*Attorney, Agent, or Firm*—Cushman, Darby & Cushman

[57] ABSTRACT

There is disclosed a good thermosensitive recording material, having excellent thermal response and having minimal adhesion to a thermal head, which comprises a support having provided thereon a thermosensitive recording layer comprising:

(1) a substantially colorless dye precursor, (2) an electron donating developer capable of developing a color of the dye precursor, and, (3) as an additive, 2-benzyloxynaphthalene and p-benzylbiphenyl in a mixing ratio of 95:5 to 70:30 (by weight).

4 Claims, No Drawings

THERMOSENSITIVE RECORDING MATERIALS

BACKGROUND OF THE INVENTION

1. Field of the Invention

The present invention relates to thermosensitive recording materials having excellent thermal response, having minimized adhesion to a thermal head and minimized background fogging due to heat accumulation on a thermal head.

2. Discussion of Related Art

Thermosensitive recording materials are generally composed of a support having provided thereon a thermosensitive recording layer containing as major constituents an ordinarily colorless or slightly colored dye precursor and an electron receptive developer. Upon being heated by means of a thermal head, thermal pen or laser beam, the dye precursor instantaneously reacts with the developer to form a recorded image, as disclosed in Japanese Patent Examined Publication Nos. 4160/68, 14039/70, etc. Because of the advantages of relatively simple design of devices and easy maintenance, the recording devices employing such thermosensitive recording materials are being used in a wide field including recording instruments for measurements, facsimiles, printers, terminal devices for computers, labels, and automatic vending machines for railroad tickets and the like. Particularly in the field of facsimiles, demand for thermal sensitive mode has been greatly increasing and the performance of facsimiles has become high speed due to reduction in transmission costs. In response to such high speed performance required for facsimiles, high sensitivity of thermosensitive recording materials has been demanded. On the other hand, in thermosensitive recording materials, an electron donating dye precursor and an electron receptive developer melt upon heating with a thermal head to form a color and the melted material may adhere to the thermal head on some occasions, resulting in damaging the head or deteriorating the quality of the printed characters.

As a countermeasure, it is disclosed in Japanese Patent Unexamined Publication No. 86229/78 to incorporate pigments having high oil absorption. It is also disclosed in Japanese Patent Unexamined Publication Nos. 23545/79, 25845/79 and 0704/79 to provide an intermediate layer between a support and a thermosensitive recording layer.

However, these compositions do not necessarily achieve the desired effects.

SUMMARY OF THE INVENTION

An object of the present invention is to provide thermosensitive recording materials having excellent thermal response, having minimized adhesion to a thermal head and minimized background fogging due to heat accumulation on a thermal head.

DETAILED DESCRIPTION OF THE PREFERRED EMBODIMENTS

There is thus provided a good thermosensitive recording material having excellent thermal response and having minimized adhesion to a thermal head which comprises a support having provided thereon a thermosensitive recording layer comprising:

(1) a substantially colorless dye precursor, (2) an electron donating developer capable of developing a color of the dye precursor, and, (3) as an additive, 2-benzyloxynaphthalene and p-benzylbiphenyl in a mixing ratio of 95:5 to 70:30 (by weight).

The term "substantially colorless" dye precursor as used throughout the specification refers to an ordinarily colorless or slightly colored dye precursor.

In cases where the mixing ratio of 2-benzyloxynaphthalene to p-benzylbiphenyl exceeds the uppermost limit 95:5, the desired effect of reducing the adherence of melted materials to a head is poor. Further in cases where the addition rate of p-benzylbiphenyl exceeds 30%, fogging forms on white paper due to heat accumulation on the thermal head, resulting in deterioration in quality of the printed characters, although adherence of melted materials decreases. More preferred is a mixing ratio of 85:15 to 75:25 (by weight).

The additive in accordance with the present invention is incorporated generally in an amount of 5 wt % or more, based on the developer, preferably 10 to 400 wt %, particularly preferably 20 to 300 wt %.

With the addition of an amount less than 5 wt % or more than 400 wt %, a sufficient color density cannot be obtained.

The thermosensitive recording material of the present invention may be prepared in a conventional manner as far as the additive described above is employed. Examples of the other constituents are given below.

The dye precursor used in the present invention is not particularly limited as long as it is usable in ordinary pressure-sensitive recording paper, thermosensitive recording paper, etc. Specific examples include: (1) triarylmethane compounds such as 3,3-bis(p-dimethylaminophenyl)-6-dimethylaminophthalide (Crystal Violet lactone), 3,3-bis(p-dimethylaminophenyl)phthalide, 3-(p-dimethylaminophenyl)-3-(1,2-dimethylindol-3-yl)phthalide, 3-(p-dimethylaminophenyl)-3-(2-methylindol-3-yl)phthalide, 3-(p-dimethylaminophenyl)-3-(2-phenylindol-3-yl)phthalide, 3,3-bis(1,2-dimethyl-indol-3-yl)-5-dimethylaminophthalide, 3,3-bis(1,2-dimethylindol-3-yl)-6-dimethylaminophthalide, 3,3-bis(9-ethylcarbazol-3-yl)-5-dimethylaminophthalide, 3,3-bis(2-phenylindol-3-yl)-5-dimethylaminophthalide, 3-p-dimethylaminophenyl-3-(1-methylpyrrol-2-yl)-6-dimethylaminophthalide, etc.; (2) diphenylmethane compounds such as 4,4'-bis-dimethylaminobenzhydryl benzyl ether, N-halophenyl leuco Auramine, N-2,4,5-trichlorophenyl leuco Auramine, etc.; (3) xanthene compounds such as Rhodamine B anilinolactam, Rhodamine B p-chloroanilinolactam, 3-diethylamino-7-dibenzylaminofluorane, 3-diethylamino-7-octylaminofluorane, 3-diethylamino-7-(3,4-dichloroanilino)fluorane, 3-diethylamino-7-(2-chloroanilino)fluorane, 3-diethylamino-6-methyl-7-anilinofluorane, 3-piperidino-6-methyl-7-anilinofluorane, 3-ethyl-tolylamino-6-methyl-7anilinofluorane, 3-ethyl-tolylamino-6-methyl-7-phenethylfluorane, 3-diethylamino-7-(4-nitroanilino)fluorane, 3-dibutylamino-6-methyl-7-anilinofluorane, 3-(N-methyl-N-propyl)amino-6-methyl-7-anilinofluorane, 3-(N-ethyl-N-isopropyl)amino-6-methyl-7-anilinofluorane, 3-(N-ethyl-N-tetrahydrofurfuryl)amino-6-methyl-7-anilinofluorane, etc.; (4) thiazine compounds such as benzoyl leuco methylene blue, p-nitrobenzoyl leuco methylene blue, etc.; (5) spiro compounds such as 3-methyl-spiro-dinaphthopyran, 3-ethyl-spirodinaphthopyran, 3,3'-dichloro-spiro-dinaphthopyran, 3-benzyl-spiro-dinaphthopyran, 3-methylnaphtho-(3-methoxybenzo)spiropyran, 3-propyl-spiro-dibenzopyran, etc.; or mixtures thereof.

These dye precursors are employed depending upon application and properties desired.

As the dye precursor, acidic substances that are generally used for thermosensitive paper, namely, electron donating compounds are used; in particular, phenol derivatives, aromatic carboxylic acid derivatives, N,N'-diarylthiourea derivatives, polyvalent metal salts such as zinc salts of organic compounds, etc. are used.

Particularly preferred are phenol derivatives. Specific examples are p-octylphenol, p-tert-butylphenol, p-phenylphenol, 1,1-bis(p-hydroxyphenyl)propane, 1,1-bis(p-hydroxyphenyl)pentane, 1,1-bis(p-hydroxyphenyl)hexane, 2,2-bis(p-hydroxyphenyl)hexane, 1,1-bis(p-hydroxyphenyl)-2-ethylhexane, 2,2-bis(4-hydroxy-3-dichlorophenyl)propane, benzyl p-hydroxybenzoate, ethyl p-hydroxybenzoate, butyl p-hydroxybenzoate, etc.

Examples of binders include water soluble binders such as starches, hydroxyethyl cellulose, methyl cellulose, carboxymethyl cellulose, gelatin, casein, polyvinyl alcohol, modified polyvinyl alcohol, styrene-maleic anhydride copolymer, ethylene-maleic anhydride copolymer, etc.; latex type water soluble binders such as styrene-butadiene copolymer, acrylonitril-butadiene copolymer, methyl acrylate-butadiene copolymer, etc.

Examples of the pigment include diatomaceous earth, talc, kaolin, sintered kaolin, calcium carbonate, magnesium carbonate, titanium oxide, zinc oxide, silicon oxide, aluminum hydroxide, urea-formalin resin, etc.

In addition, there may be incorporated, for purposes of preventing heads abrasion, prevention of sticking, etc., higher fatty acid metal salts such as zinc stearate, calcium stearate, etc.; waxes such as paraffin, oxidized paraffin, polyethylene, oxidized polyethylene, stearic amide, castor wax, etc.; dispersing agents such as sodium dioctylsulfosuccinate, etc.; UV absorbing agents of benzophenone type, benzotriazole type, etc. and further surface active agents, fluorescent dyes, etc.

As the support used for the thermosensitive recording material in accordance with the present invention, paper is mainly used. A variety of non-woven cloth, plastic film, synthetic paper, metal foil and the like or a mixture thereof may optionally be employed.

EXAMPLES

Next, the present invention will be described in more detail by referring to the examples, wherein parts and % are all by weight.

Example 1

(1) Preparation of Solution A

| | |
|---|---|
| 3-Diethylamino-6-methyl-7-anilinofluorane | 10 parts |
| 10% Polyvinyl alcohol aqueous solution | 10 parts |
| Water | 30 parts |

This composition was ground into a mean grain diameter of 2 μm with a sand grinder.

(2) Preparation of Solution B

| | |
|---|---|
| 2,2-Bis(4-hydroxyphenyl)-propane | 10 parts |
| 10% Polyvinyl alcohol aqueous solution | 10 parts |
| Water | 30 parts |

This composition was ground into a mean grain diameter of 2 μm with a sand grinder.

(3) Preparation of Solution C

| | |
|---|---|
| 2-Benzyloxynaphthalene | 10 parts |
| 10% Polyvinyl alcohol aqueous solution | 10 parts |
| Water | 30 parts |

This composition was ground into a mean grain diameter of 2 μm with a sand grinder.

(4) Preparation of Solution D

| | |
|---|---|
| p-Benzylbiphenyl | 10 parts |
| 10% Polyvinyl alcohol aqueous solution | 10 parts |
| Water | 30 parts |

This composition was ground into a mean grain diameter of 2 μm with a sand grinder.

(5) Formation of Recording Layer

Solution A, 15 parts, 20 parts of Solution B, 23.75 parts of Solution C, 1.25 parts of Solution D, 20 parts of 10% polyvinyl alcohol aqueous solution, 10 parts of calcium carbonate and 45 parts of water were mixed and stirred to make a coating solution. The resulting coating solution was coated onto a base paper having a weight of 50 g/m$^2$ in a coated amount of 4.8 g/m$^2$ as a solid content. After drying, calendering was performed in such a manner that a Beck smoothness became 400 to 500 seconds on the coated surface. Thus, a thermosensitive

Example 2

A thermosensitive recording material was obtained in a manner similar to Example 1 except that the addition amounts of Solution C and Solution D were changed to 22.5 parts and 2.5 parts.

Example 3

A thermosensitive recording material was obtained in a manner similar to Example 1 except that the addition amounts of Solution C and Solution D were changed to 21.25 parts and 3.75 parts.

Example 4

A thermosensitive recording material was obtained in a manner similar to Example 1 except that the addition amounts of Solution C and Solution D were changed to 18.75 parts and 6.25 parts.

Example 5

A thermosensitive recording material was obtained in a manner similar to Example 1 except that the addition amounts of Solution C and Solution D were changed to 17.5 parts and 7.5 parts.

Example 6

A thermosensitive recording material was obtained in a manner similar to Example 2 except that 3-diethylamino-6-methyl-7-anilinofluorane in Solution A was changed to 3-diethylamino-6-methyl-7-anilinofluorane.

Comparative Example 1

A thermosensitive recording material was obtained in a manner similar to Example 1 except that the addition amounts of Solution C and Solution D were changed to 25 parts and 0 part.

Comparative Example 2

A thermosensitive recording material was obtained in a manner similar to Example 1 except that the addition amounts of Solution C and Solution D were changed to 15 parts and 10 parts.

Comparative Example 3

A thermosensitive recording material was obtained in a manner similar to Example 1 except that the addition amounts of Solution C and Solution D were changed to 0 part and 25 parts.

With respect to the foregoing thermosensitive recording materials, dynamic color forming properties, amount of adhesion to a thermal head and thermal fogging caused by heat accumulation with the thermal head were tested. The results are shown in Table 1.

The tests were performed as described below.

(1) Dynamic color forming properties

Printing was performed in a copying mode using Facsimile Canofax 220 manufactured by Canon Inc. and a color density was measured with a reflection densitometer of Macbeth RD-514 model.

(2) Amount of adhesion to a thermal head

An original having a black rate of 50% was printed in 100 meters in a copying mode using Facsimile Canofax 220 manufactured by Canon Inc. and the amount of foreign matters adhered was observed.

(3) Thermal fogging caused by heat accumulation with a thermal head

An original having a black rate of 50% was printed in 100 meters in a copying mode using Facsimile Canofax 220 manufactured by Canon Inc. and a color density was measured with a reflection densitometer of Macbeth RD-514 model.

TABLE 1

| | Results of Evaluation | | | |
|---|---|---|---|---|
| | Dynamic Color Forming Property | Amount of Adhesion | Thermal Fogging | Ratio of 2-Benzyloxynaphthalene to p-Benzylbiphenyl |
| Example 1 | 1.32 | Δ | 0.08 | 95/5 |
| Example 2 | 1.31 | o | 0.09 | 90/10 |
| Example 3 | 1.31 | o | 0.12 | 85/15 |
| Example 4 | 1.31 | o | 0.15 | 75/25 |
| Example 5 | 1.31 | o | 0.17 | 70/30 |
| Example 6 | 1.31 | o | 0.10 | 85/15 |
| Comparative | | | | |
| Example 1 | 1.32 | x | 0.06 | 100/0 |
| Example 2 | 1.30 | o | 0.30 | 60/40 |
| Example 3 | 1.30 | o | 0.35 | 0/100 |

Evaluation of amount of melted matters adhered:
o . . . Adhesion hardly occurred.
Δ . . . Adhesion somewhat occurred.
x . . . Adhesion occurred to a great extent.

As is evident from the results of Table 1, the thermosensitive recording materials of the present invention showed properties that the adhesion to the thermal head were minimized and background fogging due to thermal head heat accumulation was minimized as compared to conventional thermosensitive recording materials, while maintaining excellent thermal response, by incorporating 2-benzyloxynaphthalene and p-benzylbiphenyl in a mixing ratio of 95:5 to 70:30 (by weight).

What is claimed is:

1. A thermosensitive recording material comprising an underlying support having provided thereon a thermosensitive recording layer comprising:
(1) a substantially colorless dye precursor,
(2) an electron donating developer capable of developing a color of the dye precursor, and,
(3) as an additive, 2-benzyloxynaphthalene and p-benzylbiphenyl in a mixing ratio of 95:5 to 70:30 (by weight).

2. The thermosensitive recording material of claim 1, wherein said 2-benzyloxynaphthalene and p-benzylbiphenyl is mixed in a ratio of 85:15 to 75:25 (by weight).

3. The thermosensitive recording material of claim 1, wherein said additive is incorporated in an amount of 10 to 400 wt % based on the developer.

4. The thermosensitive recording material of claim 3, wherein said additive is incorporated in an amount of 20 to 300 wt % based on the developer.

* * * * *